US011731804B2

(12) United States Patent
Dehmel et al.

(10) Patent No.: US 11,731,804 B2
(45) Date of Patent: Aug. 22, 2023

(54) PALLET INCLUDING A CARRIER ARRANGEMENT CONNECTED TO SKID ARRANGEMENTS

(71) Applicant: 2in1 AG, Sissach (CH)

(72) Inventors: Felix Dehmel, Dresden (DE); Pascal Gysin, Sissach (CH); Justus Theinert, Stuttgart (DE); Kai Weckner, Ilmenau (DE)

(73) Assignee: 2IN1 AG, Sissach (CH)

( * ) Notice: Subject to any disclaimer, the term of this patent is extended or adjusted under 35 U.S.C. 154(b) by 39 days.

(21) Appl. No.: 17/439,240

(22) PCT Filed: Mar. 12, 2020

(86) PCT No.: PCT/EP2020/056685
§ 371 (c)(1),
(2) Date: Sep. 14, 2021

(87) PCT Pub. No.: WO2020/182954
PCT Pub. Date: Sep. 17, 2020

(65) Prior Publication Data

US 2022/0144487 A1 May 12, 2022

(30) Foreign Application Priority Data

Mar. 14, 2019 (DE) ..... 10 2019 203 480.2

(51) Int. Cl.
*B65D 19/00* (2006.01)

(52) U.S. Cl.
CPC ..... *B65D 19/0048* (2013.01); *B65D 19/004* (2013.01); *B65D 2519/00029* (2013.01); *B65D 2519/00034* (2013.01); *B65D 2519/00039* (2013.01); *B65D 2519/00064* (2013.01); *B65D 2519/00069* (2013.01); *B65D 2519/00074* (2013.01); *B65D 2519/0099* (2013.01); *B65D 2519/00129* (2013.01); *B65D 2519/00139* (2013.01); *B65D 2519/00268* (2013.01); *B65D 2519/00273* (2013.01); *B65D 2519/00288* (2013.01); *B65D 2519/00308* (2013.01);
(Continued)

(58) Field of Classification Search
CPC ..... B65D 2519/00273; B65D 2519/00308; B65D 2519/00034; B65D 2519/00363
USPC ..... 108/57.25, 57.19
See application file for complete search history.

(56) References Cited

U.S. PATENT DOCUMENTS 3,824,933 A * 7/1974 Lind ..... B65D 19/0012 108/56.1
5,117,762 A * 6/1992 Shuert ..... B65D 19/0022 108/57.25
(Continued)

FOREIGN PATENT DOCUMENTS

CN 203 946 355 U 11/2014
DE 20105233 U1 10/2001
(Continued)

*Primary Examiner* — Jose V Chen
(74) *Attorney, Agent, or Firm* — McGlew and Tuttle, P.C.

(57) ABSTRACT

A pallet has a carrier arrangement (1), with at least one platform or base surface (6), for carrying at least one item and at least two skid arrangements (2) and at least two coupling arrangements (3). The at least two coupling arrangements (3) are provided for intercoupling the carrier arrangement (1) and the skid arrangements (2) when needed.

23 Claims, 6 Drawing Sheets

(52) U.S. Cl.
CPC ..... *B65D 2519/00318* (2013.01); *B65D 2519/00323* (2013.01); *B65D 2519/00333* (2013.01); *B65D 2519/00338* (2013.01); *B65D 2519/00363* (2013.01); *B65D 2519/00402* (2013.01); *B65D 2519/00437* (2013.01); *B65D 2519/00442* (2013.01); *B65D 2519/00567* (2013.01)

(56) References Cited

U.S. PATENT DOCUMENTS

| | | | | |
|---|---|---|---|---|
| 5,417,167 | A * | 5/1995 | Sadr | B65D 19/0093 108/901 |
| 5,445,084 | A | 8/1995 | Durand | |
| 5,941,179 | A * | 8/1999 | Herring | B65D 19/0091 108/56.3 |
| 6,029,583 | A * | 2/2000 | LeTrudet | B65D 19/0012 108/57.25 |
| 6,109,190 | A * | 8/2000 | Hale | B65D 19/0016 108/57.25 |
| 6,305,301 | B1 * | 10/2001 | Piper, Jr | B65D 19/0048 108/57.25 |
| 6,840,181 | B2 * | 1/2005 | Smyers | B65D 19/0012 108/57.25 |
| 7,490,561 | B1 * | 2/2009 | Chou | B65D 19/0095 108/56.1 |
| 7,748,329 | B2 * | 7/2010 | Baltz | B65D 19/0048 108/57.25 |
| 8,434,618 | B2 * | 5/2013 | Mitchell | B65D 19/06 206/386 |
| 8,770,115 | B2 * | 7/2014 | Apps | B65D 19/0004 108/57.25 |
| 8,950,342 | B2 * | 2/2015 | Plattner | B65D 19/0016 108/57.25 |
| 2002/0011194 | A1 * | 1/2002 | Lacabanne | B65D 19/0085 108/57.19 |
| 2005/0268824 | A1 * | 12/2005 | Williams | B65D 19/0095 108/57.25 |
| 2006/0096508 | A1 * | 5/2006 | Herring | B65D 19/0095 108/54.1 |
| 2006/0169185 | A1 * | 8/2006 | Williams | B65D 19/0095 108/56.3 |
| 2007/0234933 | A1 * | 10/2007 | Donnell, Jr. | B65D 19/0016 108/56.3 |
| 2008/0210140 | A1 * | 9/2008 | Valentinsson | B65D 19/0014 108/51.11 |
| 2008/0236455 | A1 * | 10/2008 | Naidu | B65D 19/0038 24/453 |
| 2013/0160680 | A1 * | 6/2013 | Ten Bok | B29C 69/02 264/41 |
| 2014/0000494 | A1 | 1/2014 | Gysin et al. | |
| 2018/0141710 | A1 * | 5/2018 | Storteboom | B65D 19/0073 |
| 2020/0031522 | A1 * | 1/2020 | Shawaf | B65D 19/38 |
| 2020/0031523 | A1 * | 1/2020 | Lantz | B65D 19/0071 |
| 2020/0031524 | A1 * | 1/2020 | Lantz | B65D 19/0095 |
| 2020/0207512 | A1 * | 7/2020 | Marconel Carpio | B65D 19/0093 |
| 2022/0002027 | A1 * | 1/2022 | Sostmann | B65D 19/0026 |

FOREIGN PATENT DOCUMENTS

| | | | |
|---|---|---|---|
| DE | 102007009762 | A1 | 8/2008 |
| DE | 102008006388 | A1 | 8/2009 |
| EP | 0169090 | A1 | 1/1986 |
| EP | 2216255 | A1 | 8/2010 |
| GB | 2280663 | A | 2/1995 |

* cited by examiner

PALLET INCLUDING A CARRIER ARRANGEMENT CONNECTED TO SKID ARRANGEMENTS

CROSS REFERENCE TO RELATED APPLICATIONS

This application is a United States National Phase Application of International Application PCT/EP 2020/056685, filed Mar. 12, 2020, and claims the benefit of priority under 35 U.S.C. § 119 of German Application 10 2019 203 480.2, filed Mar. 14, 2019, the entire contents of which are incorporated herein by reference.

TECHNICAL FIELD

The present invention pertains to a pallet. Furthermore, the present invention is aimed at a carrier arrangement of such a pallet. The present invention is, in addition, aimed at a skid arrangement of such a pallet.

TECHNICAL BACKGROUND

Pallets are generally known from the state of the art through prior public use. They have proven to be particularly successful in practice for transporting or storing items.

SUMMARY

A basic object of the present invention is to provide an improved pallet. A pallet shall be created, in particular, which is especially simple and easy to handle and is extremely user-friendly. Also, a corresponding carrier arrangement and skid arrangement for such a pallet shall be provided.

This object is accomplished according to the present invention by a pallet, which comprises a) a carrier arrangement, having at least one base surface, for carrying at least one item, at least two skid arrangements, and at least two coupling arrangements for coupling the carrier arrangement and the skid arrangements with one another as needed, and/or a carrier arrangement as a component of such a pallet and/or a skid arrangement as a component of such a pallet. This object is accomplished according to the present invention by a pallet, which comprises a) a carrier arrangement, having at least one base surface, for carrying at least one item, b) at least two skid arrangements, and c) at least one reinforcing element for reinforcing the carrier arrangement and/or the respective skid arrangement.

The pallet according to the present invention can be used as a storage pallet, as a display pallet or as a transport pallet. It can be correspondingly retrofitted as needed. When the pallet is free from skid arrangements, it is especially lightweight and thus extremely easy to handle, which is especially advantageous in case of manual lifting. It can then preferably be used in an extremely visually attractive manner and preferably also as a display pallet for presentation of items. When the skid arrangements are assembled, the pallet can be used, for example, especially well in a storage area, especially in a high-shelf storage area, and/or in automated conveyor systems, such as in chain conveyor systems. According to a preferred embodiment, it can then preferably be displaced or be shifted especially well on a base in case of a corresponding configuration of the skid arrangements. Damaged skid arrangements can be removed or be replaced in an especially simple manner. The pallet is preferably configured as a reusable pallet.

The carrier arrangement has at least one support surface, which is advantageously facing opposite the at least one base surface or upwards. Items can be arranged there. The carrier arrangement is preferably rigid. It is advantageous when the carrier arrangement is symmetrical or essentially symmetrical in relation to a main plane or a plane of symmetry. It preferably has a one-piece configuration.

The skid arrangements preferably have an identical configuration. They are advantageously symmetrical or essentially symmetrical in relation to a plane of symmetry or a main plane. It is advantageous when each skid arrangement is rigid. Each skid arrangement preferably has at least one base surface.

It is advantageous when the at least one skid arrangement has a width in its transverse extension that is smaller, especially considerably smaller, than the width of the carrier arrangement. The at least one skid arrangement has a length, which corresponds (approximately) to the length of the carrier arrangement. The at least one skid arrangement is, for example, (slightly) longer than the carrier arrangement.

The coupling arrangements are preferably identical. They preferably make possible a frictional connection and/or a positive-locking connection between the carrier arrangement and the respective skid arrangement.

It is advantageous when a positive-locking connection and/or frictional connection, which makes it possible to compensate for tolerances, is present between the carrier arrangement and the respective skid arrangement in a use position. For this purpose, at least one surface at the carrier arrangement and/or at the respective skid arrangement has an increased roughness and/or at least one groove, and preferably a plurality of grooves. For example, a positive locking connection and/or a frictional connection is present between surfaces that come into contact with each other.

It is advantageous when the carrier arrangement has at least one shaped outer edge in order to allow a secure stacking of empty carrier arrangements and/or pallets.

Advantageously, the pallet is chemically treated or coated in at least some areas, preferably entirely, for an increased flame protection or fire protection.

The carrier arrangement advantageously comprises especially a first coupling part, at least one second coupling unit or second coupling part which is preferably arranged at a respective partial block and/or at least one locking unit.

The skid arrangement advantageously comprises especially a first counter coupling part, at least one second counter coupling unit or second counter coupling part which is preferably arranged at a respective partial block, and/or at least one counter locking unit.

The pallet with at least one reinforcing element for reinforcing the carrier arrangement and/or the respective skid arrangement is again especially user-friendly. In particular, it is especially able to bear a load or is loadable because of the at least one reinforcing element. The pallet is advantageously also extremely lightweight, which is achieved, for example, due to the use of different materials.

It is advantageous when the at least one reinforcing element is formed or consists of a different material than the carrier arrangement and/or the skid arrangement. In the carrier arrangement and/or in the respective skid arrangement, preferably at least one corresponding depression, recess, receptacle or the like is configured for receiving the at least one reinforcing element.

The at least one reinforcing element can be manufactured, for example, by pultrusion/extrusion. It consists, for example, of (aluminum) sheet or polyethylene, such as fiber-reinforced, and especially endless-fiber-reinforced, polyethylene. It can preferably be welded on, when it is configured as polyethylene fiber tape. When the at least one reinforcing element is configured as aluminum sheet, joining is preferably carried out, in particular, by means of a positive locking connection, by locally melting the carrier arrangement or the respective skid arrangement. A type of plastic rivet head is preferably formed. The aluminum sheet is preferably a rolled aluminum sheet, which is subjected advantageously to a subsequent rolling stamping operation or to a bending stamping operation. It is advantageous when the aluminum sheet has at least one rolled area or bent area. It is preferably anodized, above all to achieve an especially high surface hardness.

As an alternative, the at least one reinforcing element consists, for example, of steel sheet, and high-strength steel in particular. It is advantageous when the steel sheet is galvanized in at least some areas. It is advantageously perforated. It is advantageous when the steel sheet is trapezoidal or essentially trapezoidal. The steel sheet is advantageously configured as a strip sheet of steel. It is advantageous when the at least one reinforcing element is extrusion-coated in at least some areas by material of the carrier arrangement or of the respective skid arrangement.

The indefinite articles mentioned in the claims shall not represent a quantitative limitation here.

Additional advantageous embodiments of the present invention are described herein.

The embodiment in which the carrier arrangement and the skid arrangements can be uncoupled from one another by means of the respective coupling arrangement also allows an especially simple retrofitting of the pallet. Retrofits can be carried out as often as desired depending on need, which is extremely user-friendly.

The embodiment in which each of the coupling arrangements can be actuated without the use of tools is again especially user-friendly. The at least two skid arrangements can preferably be arranged at the carrier arrangement without the use of tools. It is advantageous when the skid arrangement can be uncoupled or can be removed from the carrier arrangement without the use of tools.

The carrier arrangement in which the carrier arrangement has partial blocks at the bottom itself has a preferably pallet-like configuration. It thus becomes possible to grip under a carrier plate of the carrier arrangement by means of a lifting device, such as a lift truck, and thus to raise the pallet and possibly items arranged on this pallet.

The embodiment in which each of the skid arrangements has a one-piece configuration is extremely user-friendly. The pallet has very few components or individual parts.

The pallet in which the coupling arrangements comprise a first coupling device and at least one second coupling device which differ structurally from the first coupling device allows an especially secure and loadable coupling between the carrier arrangement and the respective skid arrangement. The coupling devices differ, for example, in their operating principle, in their configuration, in their coupling movement and/or in their uncoupling movement. The coupling devices are preferably arranged at spaced locations from one another.

The first coupling device being configured as a bayonet device or in the manner of a bayonet device preferably allows a coupling or uncoupling due to a combination of an insertion movement or axial movement and a rotating movement or pivoting movement of the carrier arrangement and of the respective skid arrangement relative to one another. During use, it prevents especially a separation between the carrier arrangement and the respective skid arrangement at right angles to the at least one support surface or base surface.

The dovetail device, being preferably configured as a dovetail connection or a dovetail guide, is especially capable of holding the respective skid arrangement securely at the carrier arrangement. During the use, it especially prevents a separation between the carrier arrangement and the respective skid arrangement in a longitudinal direction of the skid arrangement and at right angles to the at least one support surface or base surface.

The at least one second coupling device comprising at least one second coupling unit, which extends in an arc-shaped manner, especially in a circular arc-shaped manner, at the carrier arrangement and at least one second counter coupling unit at the respective skid arrangement, which counter coupling unit is complementary to the at least one second coupling unit and extends in an arc-shaped manner, especially in a circular arc-shaped manner is especially easy to handle and is loadable. The at least one second coupling unit is configured, for example, as a groove, especially as a trapezoidal groove or as a dovetail groove. The at least one second counter coupling unit is configured, for example, as a pin or as a dovetail body. A reverse arrangement is possible, as an alternative.

The first coupling part arranged at the carrier arrangement and a first counter coupling part, which is arranged at the respective skid arrangement for interacting with the first coupling part preferably has at least one retaining web. The first counter coupling part preferably comprises at least one retaining projection. They can preferably be displaced or pivoted in relation to one another. A reverse arrangement is possible, as an alternative.

The first partial blocks advantageously form at least one entire block in the assembled state of the respective skid arrangement.

The at least one second coupling part advantageously comprises at least one second coupling unit. It is advantageous when the at least one counter coupling part has at least one counter coupling unit.

The second partial blocks preferably at least one entire block in the assembled state of the respective skid arrangement.

A locking connection, which can be brought about and/or can be released again preferably without the use of tools, may act between the carrier arrangement and the respective skid arrangement in the assembled state of the respective skid arrangement. Each safety locking unit preferably has a locking unit arranged at the carrier arrangement and a counter locking unit arranged at the respective skid arrangement. The locking unit is configured, for example, as a projection, such as a lug. The counter locking unit is configured, for example, as an opening, recess or the like. It is advantageous when the safety locking units are capable of preventing a pivoting movement between the carrier arrangement and the respective skid arrangement in their locked position. The respective safety locking unit preferably also forms an end stop during the assembly of a skid arrangement, which simplifies the assembly. A reverse arrangement is possible, as an alternative.

The at least one sensor is, for example, configured as a temperature sensor, motion sensor, acceleration sensor, weight sensor, geotracking sensor, charging history sensor, moisture sensor, orientation sensor, such as in form of a level, or theft protection sensor, for example, in the form of a seal, such that the item arranged on the carrier arrangement is present. The sign provides, for example, information with regard to recycling, including the date of manufacture, age of the pallet, its composition and/or the owner. The at least one receiving space is formed, for example, by a hollow chamber of the carrier arrangement or skid arrangement. It is preferably spatially defined by at least one web.

It is advantageous if at least one sensor is mounted in the at least one receiving space. Information of the at least one sensor can be read, especially in a wireless manner, for example, by means of at least one transmission module of the sensor that operates, for example, by radio, such as Bluetooth or a mobile wireless device, infrared or the like. Local transmission and remote transmission are possible.

For example, the at least one sensor is configured as an RFID sensor. It is advantageous when the pallet contains at least one marker in order to obtain information about the pallet.

The at least one reinforcing element arranged at the top and/or at the bottom at a carrier plate of the carrier arrangement can be arranged in a particularly simple and functionally reliable manner at the carrier arrangement, for example, by welding or joining. It is preferably arranged on the outside or is visible from the outside. As an alternative or in addition, it is arranged on the inside or is completely embedded. The at least one reinforcing element is extrusion-coated by material of the carrier arrangement, for example, in at least some areas, preferably entirely.

The at least one reinforcing element arranged especially at the top and/or at the bottom, especially on the outside, at a bottom element of the at least one skid arrangement can be arranged at the bottom element in an especially functionally reliable and simple manner, such as by welding or joining. It is preferably arranged on the outside or is visible from the outside. As an alternative or in addition, it is arranged on the inside or is completely embedded. For example, the at least one reinforcing element is extrusion-coated by material of the respective skid arrangement in at least some areas, preferably entirely.

The at least one reinforcing element that is strip-shaped or profiled is especially torsionally rigid.

It is advantageous when the carrier arrangement and/or the skid arrangement is/are configured in a lightweight construction. It/they is/are preferably recyclable. It is advantageous when the carrier arrangement and/or the skid arrangements have renewable raw material, such as wood fibers. As an alternative or in addition, the carrier arrangement and/or skid arrangements has/have biopolymers.

The carrier arrangement can be manufactured, for example, by injection molding or pressing.

The skid arrangements can be manufactured, for example, by pultrusion/extrusion.

Preferred embodiments of the present invention will be described now as an example below with reference to the attached drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
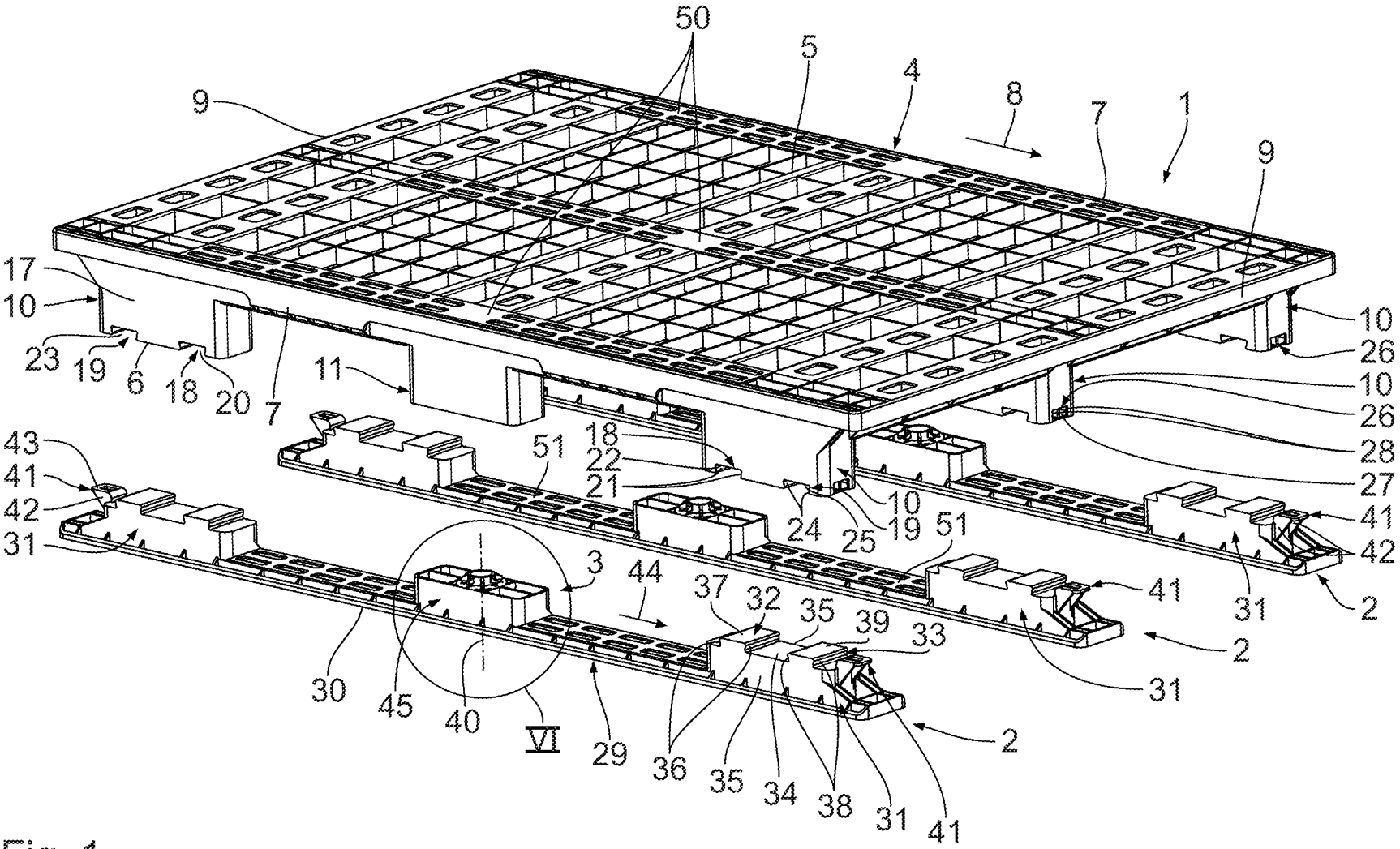
FIG. 1 is an exploded view of a pallet according to the present invention.
Figure 2:
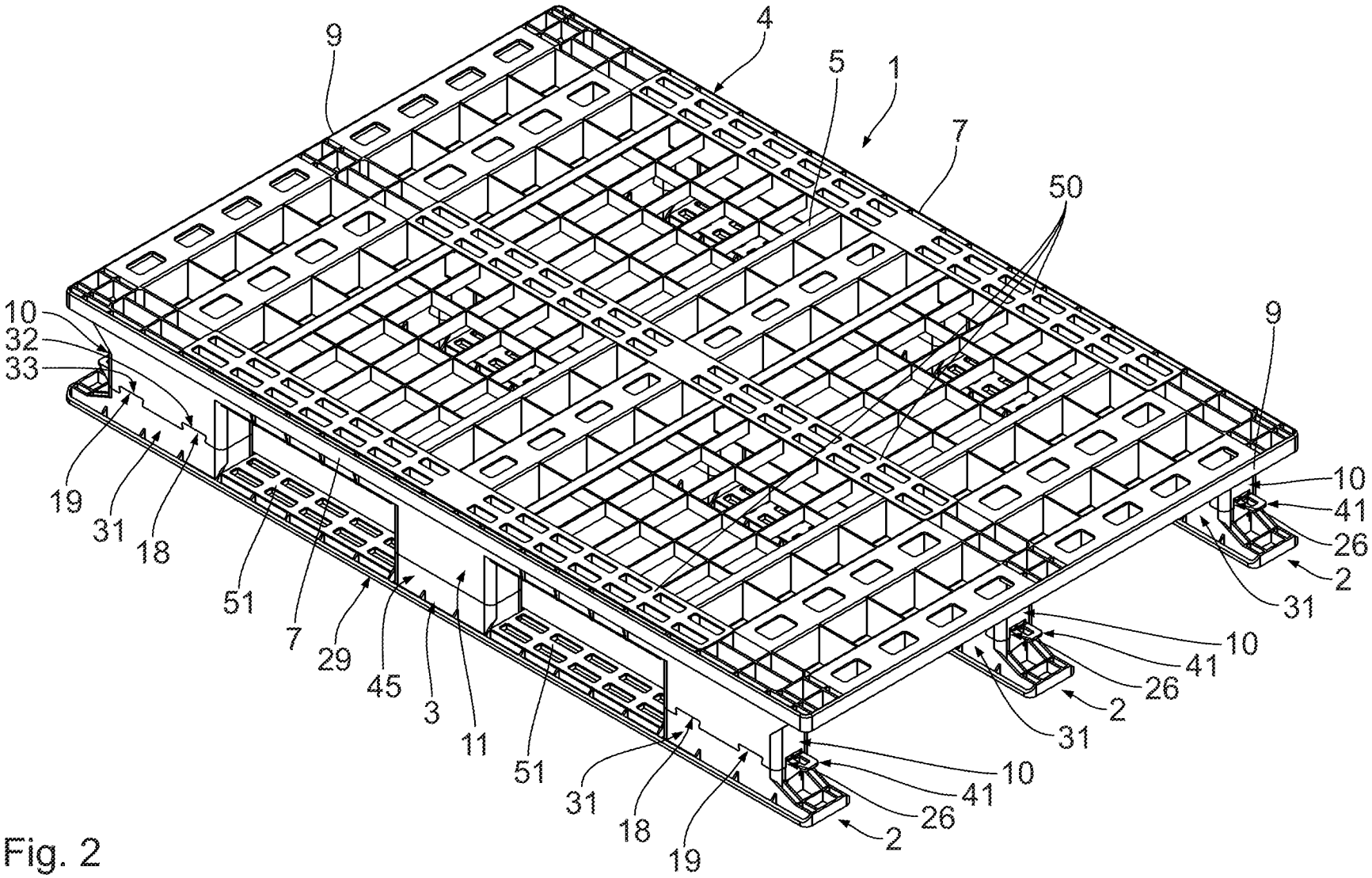
FIG. 2 is a perspective view of the pallet shown in FIG. 1 in the assembled state.
Figure 3:
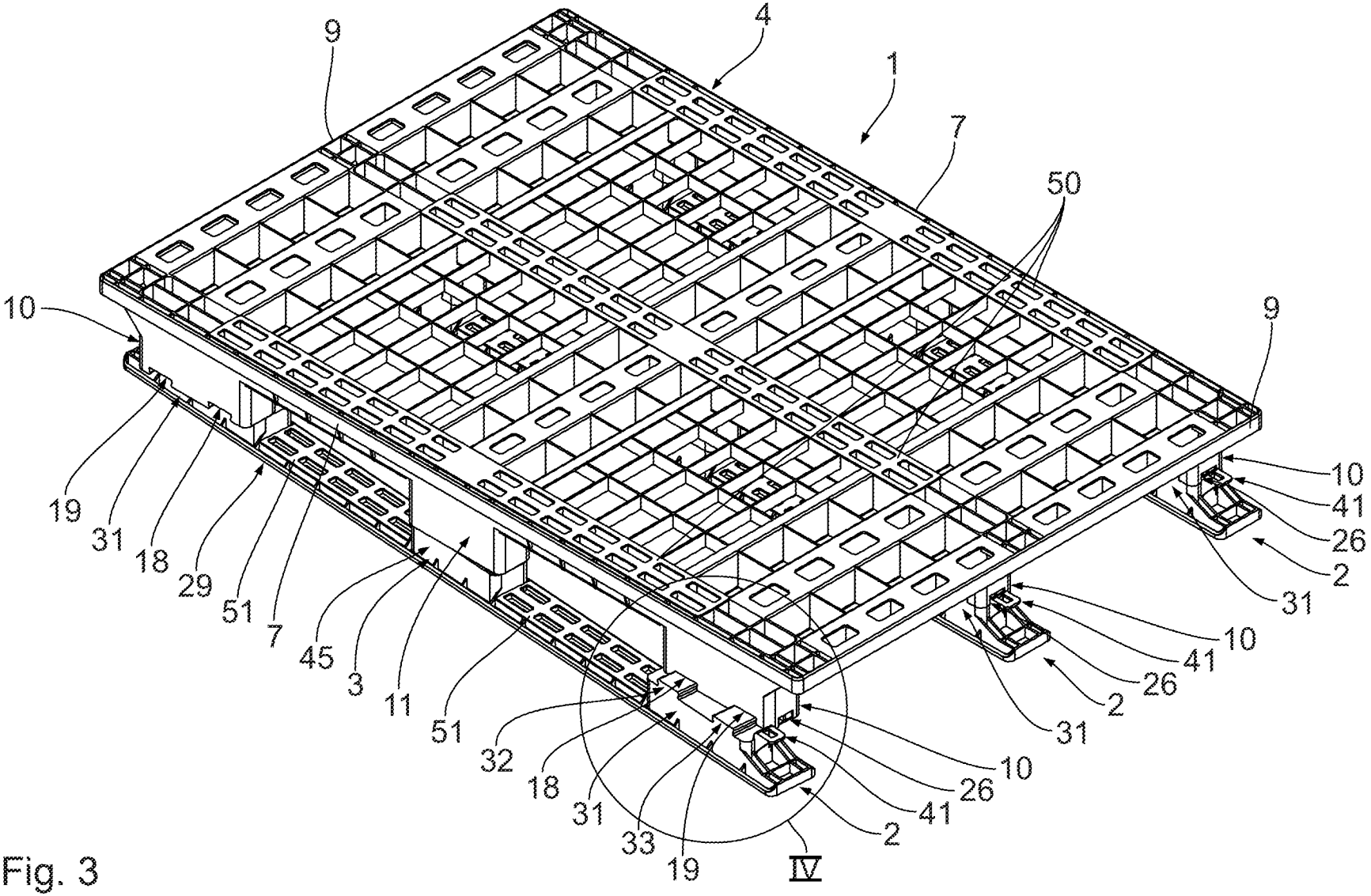
FIG. 3 is a perspective view corresponding to FIG. 2, which illustrates an assembly of a skid arrangement.
Figure 4:
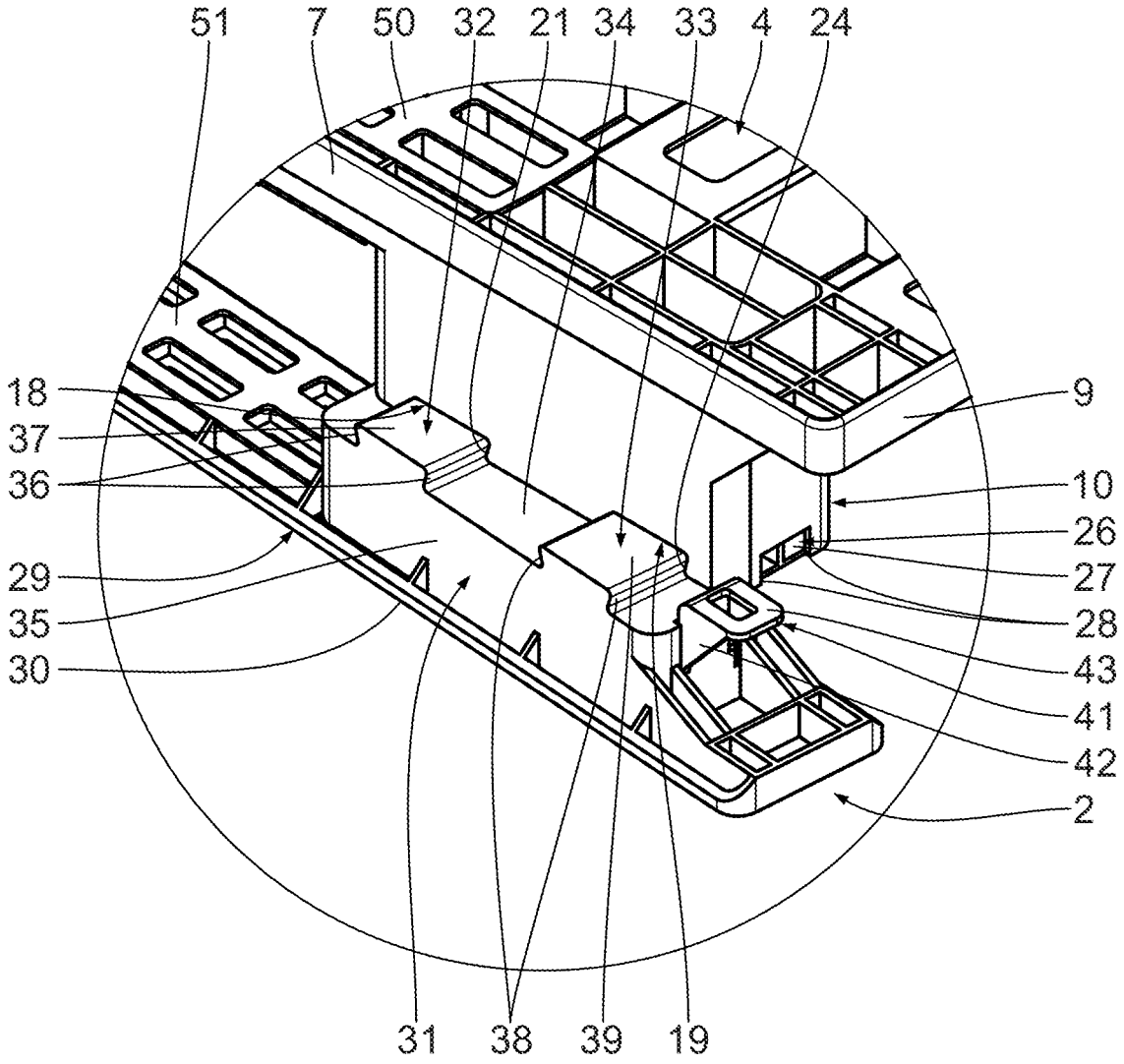
FIG. 4 is a perspective view showing detail IV identified in FIG. 3 on an enlarged scale, which illustrates a coupling unit of the pallet shown.
Figure 5:
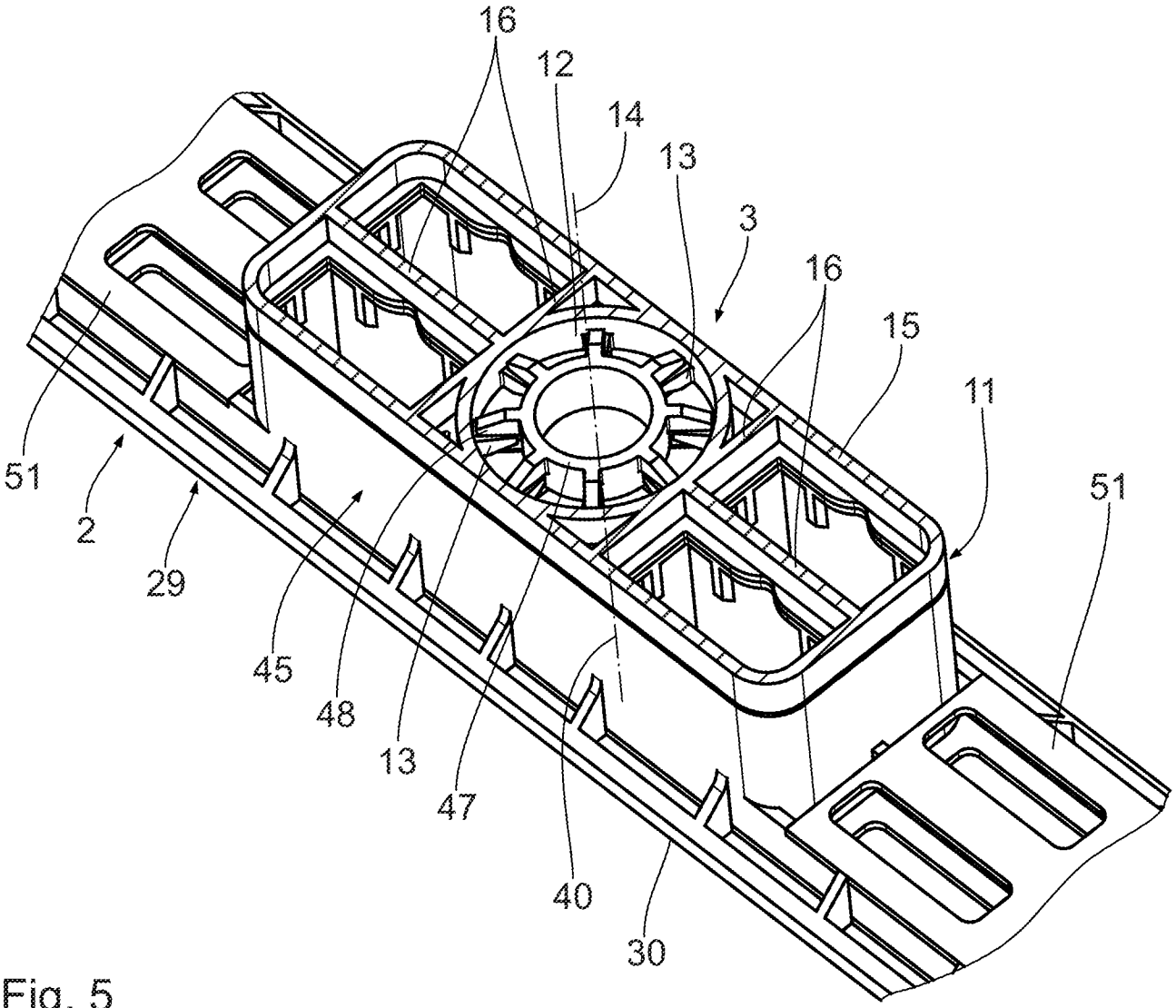
FIG. 5 is a perspective view of another coupling device of the pallet with cut partial block.
Figure 6:
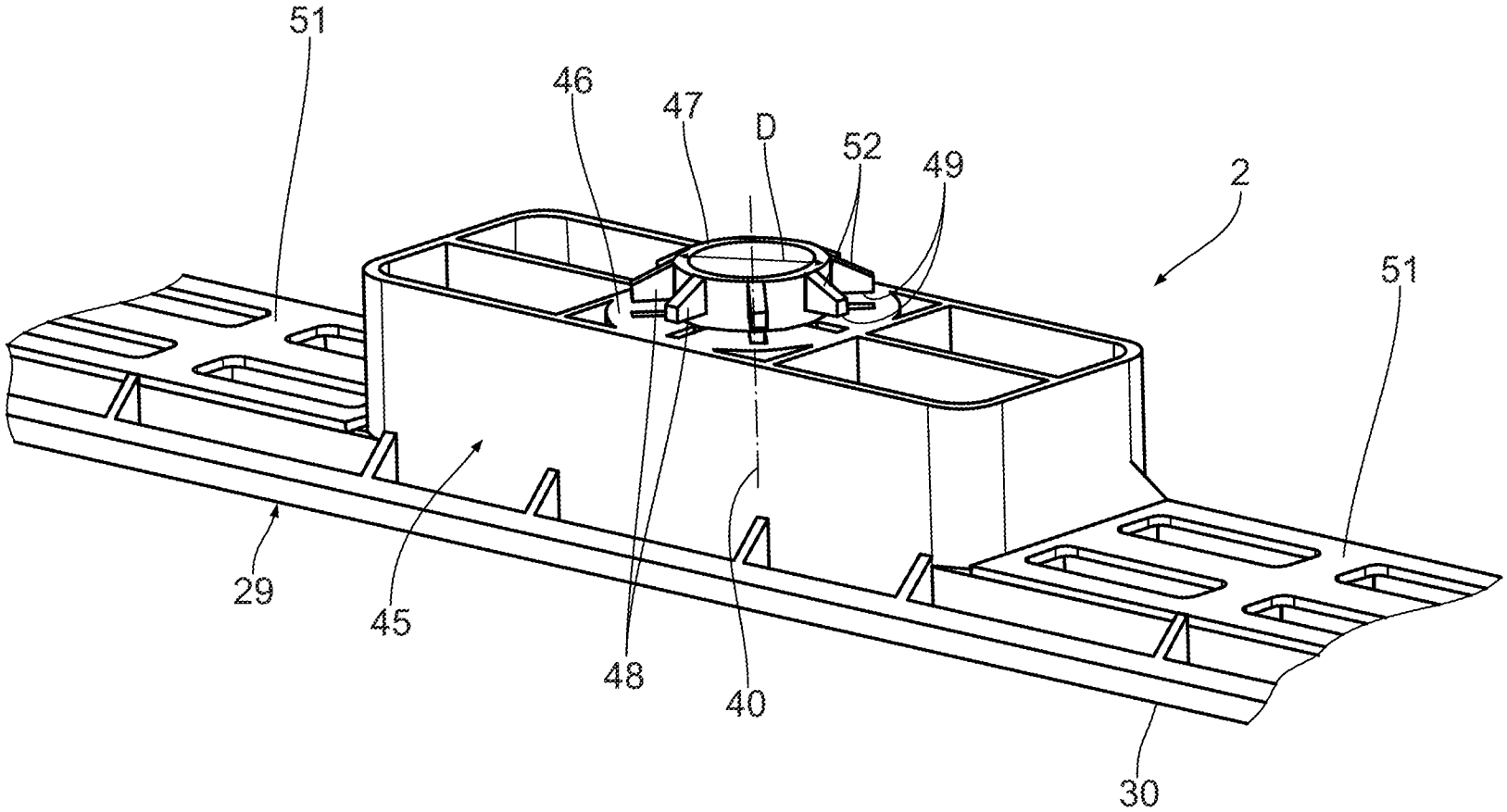
FIG. 6 is a perspective view showing detail VI identified in FIG. 1 on an enlarged scale, which illustrates a counter coupling part of the coupling device shown in FIG. 5.

Referring to the drawings, a pallet illustrated in its entirety in FIGS. 1 through 3 comprises a pallet-like carrier arrangement 1 and three skid arrangements 2. The skid arrangements 2 can be arranged at the carrier arrangement 1. In the coupled state, the skid arrangements 2 are arranged firmly, but detachably at the carrier arrangement 1. In this case, coupling arrangements 3 are active between the carrier arrangement 1 and each skid arrangement 2.

The carrier arrangement 1 comprises a carrier plate 4, which offers or forms a flat, upwards facing support surface 5 for at least one item to be carried (not shown). The carrier plate 4 is rectangular and has a plurality of rectangular hollow chambers, which are open at the top and at the bottom. The support surface 5 is formed by free ends of webs of the hollow chambers.

In addition, the carrier arrangement 1 has a plurality of partial blocks, which project from the carrier plate 4 downwards and form a base surface 6 for setting down on a base (not shown), such as a floor, or supporting against same. A total of nine partial blocks are present here. Three partial blocks extend adjacent to each longitudinal edge 7 of the carrier arrangement 1. Further, three partial blocks are arranged in a central area of the carrier arrangement 1 between the partial blocks which are arranged adjacent to the longitudinal edges 7. The carrier arrangement-side partial blocks are thus arranged next to one another in three rows, which extend in a longitudinal direction 8 of the carrier arrangement 1.

The partial blocks arranged adjacent to the transverse edges 9 of the carrier arrangement 1 are at least identical in kind. The reference number 10 is assigned to them. Partial blocks, which are at least identical in kind, are located in a central transverse plane of the carrier arrangement 1. The reference number 11 is assigned to them. The partial blocks 10, 11 differ structurally from one another.

Each partial block 11 has an essentially rectangular and elongated configuration. It has a central hollow cylinder body 12, which carries a plurality of plate-like retaining webs 13 on the inside. The retaining webs 13 are arranged at an equally angularly spaced location from the hollow cylinder body 12. They are located in a common plane running parallel to the base surface 6 and jump from the hollow cylinder body 12 towards one another in the direction of a central axis 14 of the hollow cylinder body 12, but end at a spaced location from one another. The retaining webs 13 are arranged at a spaced location from the base surface 6. Each partial block 11 has, in addition to an outer wall 15, a plurality of reinforcing webs 16.

Each partial block 10 has an essentially rectangular and elongated configuration. It has an outer wall 17 and inner stiffening webs. Each partial block 10 has at the bottom a first dovetail groove 18 and a second dovetail groove 19, which are open towards the adjacent base surface 6.

Each first dovetail groove 18 has laterally two first openings 20, which oppose one another. Each first dovetail groove 18 is defined by two first flanks, which oppose one another and which extend from the adjacent base surface 16 away from one another in the direction of the carrier plate 4. Further, each first dovetail groove 18 is defined by an inner first bottom 22, which extends parallel to the corresponding base surface 6 between the first flanks 21. The first flanks 21 and the first bottom 22 are components of the respective partial block 10. Each first dovetail groove 18 extends in a circular arc-shaped manner around the central axis 14 of the partial block 11 arranged in this row.

Each second dovetail groove 19 has laterally two second openings 23, which oppose one another. Each second dovetail groove 19 is defined by two second flanks 24, which oppose one another and which extend from the adjacent base surface 6 away from one another in the direction of the carrier plate 4. Each second dovetail groove 19 is defined by an inner second bottom 25, which extends parallel to the corresponding base surface 6 between the two flanks 24. The second flanks 24 and the second bottom 25 are components of the respective partial block 10. Each second dovetail groove 19 extends in a circular arc-shaped manner around the central axis 14 of the partial block 11 arranged in this row. Each second dovetail groove 19 has a greater distance to this central axis 14 than the adjacent first dovetail groove 18. The dovetail grooves 18, 19 of each partial block 10 run at a uniformly spaced location from one another. They extend in a curved manner in a transverse direction of the carrier arrangement 1.

The dovetail grooves 18, 19 form coupling units. They are components of a coupling part.

Each partial block 10 has, on the front side, adjacent to the transverse edge 9 a locking recess 26, the inlet opening 27 of which is facing away from a transverse plane of the carrier arrangement 1 or the partial block 11 arranged in this row. Each locking recess 26 is spatially defined by two side walls 28, which oppose one another and which extend in the longitudinal direction 8 of the carrier arrangement 1. Each locking recess 26 forms a locking unit.

The partial blocks 11 arranged in a row form outer partial blocks, while each partial block 10 in this row forms an inner or central partial block.

Each skid arrangement 2 comprises a rigid baseboard 29, which extends essentially linearly and is rectangular. Each baseboard 29 has a base surface 30 at the bottom.

Three partial blocks project from each baseboard opposite the respective base surface 30. These partial blocks are arranged at a spaced location from one another and have a distance to one another, which corresponds to the distance of the partial blocks 10, 11 of the carrier arrangement 1, which partial blocks 10, 11 are arranged in a row.

Each skid arrangement 2 has two outer partial blocks 31, which are structurally identical and are arranged in opposing end areas of the respective baseboard 29.

Each partial block 31 has at the top a first pin 32 and a second pin 33, which project upwards from a head surface 34 of the respective partial block 31 and are each configured as dovetails. Each pin 32, 33 extends between opposing side walls 35 of the respective partial block 31 or in a transverse direction of the respective skid arrangement 2.

The first pins 32 have a configuration complementary to the first dovetail grooves 18. Each first pin 32 has two opposing first side flanks 36, which extend from the adjacent head surface 34 away from one another and defined a free first roof surface 37.

The second pins 33 have a configuration complementary to the second dovetail grooves 19. Each second pin 33 has two opposing second side flanks 38, which extend from the respective head surface 34 away from one another while defining a free second roof surface 39.

The roof surfaces 37, 39 extend parallel to the adjacent head surface 34.

Each pin 32, 33 extends in a circular arc-shaped manner around a central axis 40 of the respective skid arrangement 2, which extends at right angles to the corresponding base surface 30.

The pins 32, 33 form counter coupling units for the coupling unit. They are components of a counter coupling part. The dovetail grooves 18, 19 and the pins 32, 33 are components of dovetail devices.

Each partial block 31 carries a locking body 41, which can preferably be displaced in a springy manner. The locking bodies 41 of each skid arrangement 2 face away from one another. They have a configuration complementary to the locking recesses 26 and form counter locking units for the locking units.

Each locking body 41 has two opposing locking flanks (surfaces) 42, which run parallel to one another and extend in a flat manner. The distance of the locking surfaces 42 from one another corresponds to the distance of the side walls 28 defining a locking recess 26. The locking surfaces 42 extend at right angles to the adjacent base surface 30 and parallel to a longitudinal direction 44 of the corresponding skid arrangement 2. Each locking body 41 has at the top a free actuating surface 43.

Each skid arrangement 2 comprises, in addition, a central partial block 45, which is arranged centrally between the partial blocks 31 of the respective skid arrangement 2.

Each partial block 45 has a head surface 46, which faces away from the base surface 30 of the respective skid arrangement 2. Each partial block 45 comprises a cylinder body 47, which is preferably configured as a hollow cylinder body and projects from the head surface 46 of the respective partial block 45 at right angles upwards or outwards. Each cylinder body 47 has an outer diameter D, which is, preferably slightly, smaller than an imaginary diameter or circle formed by the free ends of the retaining webs 13.

Each cylinder body 47 carries on the outside retaining projections 48, which project in the radially outward direction and are arranged at a uniformly angularly spaced location from one another. In the circumferential direction around the corresponding cylinder body 47, each retaining projection 48 has a width which is smaller than a corresponding width of a retaining web 13 in the circumferential direction around the corresponding hollow cylinder body 12.

The number of retaining projections 48 of a partial block 45 corresponds to the number of the retaining webs 13 of a partial block 11.

The retaining projections 48 are arranged at a spaced location from the adjacent head surface 46, while forming a retaining surface 49. The retaining surfaces 49 face towards the adjacent head surface 46. A distance between the head surface 46 and an adjacent retaining projection 48 is slightly greater than the thickness of a retaining web 13.

The retaining projections 48 have, opposing the retaining surfaces 49, alignment flanks 52, which run from the corresponding cylinder body 47 obliquely in the direction of the adjacent head surface 46.

The central axis 40 of the respective skid arrangement 2 is defined by the cylinder body 47.

The retaining webs 13 form coupling units for the retaining projections 48, which form counter coupling units. The retaining webs 13 are components of a coupling part. The retaining projections 48 are components of a counter coupling part. The retaining projections 48 and the retaining webs 13 are components of a bayonet device.

The carrier plate 4 has a plurality of reinforcing elements 50, which extend in the longitudinal direction 8 and are arranged at a spaced location from one another. Two of the reinforcing elements 50 extend adjacent to the longitudinal edges 7, while another reinforcing element 50 extends centrally between these in the longitudinal direction 8. It is advantageous when corresponding reinforcing elements 50 also extend on the rear side of the carrier plate 4. The reinforcing elements 50 are arranged in corresponding recesses of the carrier plate 4.

Each skid arrangement 2 has two reinforcing elements 51, which extend at the top towards the respective bottom element 29 in the longitudinal direction 44 between the partial blocks 31, 45. Advantageously, corresponding reinforcing elements 41 are also arranged on an underside of the respective bottom element 29. The reinforcing elements 51 are arranged in corresponding recesses of the respective skid arrangement 2.

The use of the pallet will be described in more detail below.

The carrier arrangement 1 can be used independently as a pallet. The support surface 5 of the carrier arrangement 1 is capable of carrying items, for example, in a stacked form. The carrier arrangement 1 can be set down in a stable manner on the bottom via its partial blocks 10, 11. The carrier plate 4 is thus arranged at a spaced location from the bottom. A lifting device may travel between the partial blocks 10, 11 under the carrier plate 4.

Skid arrangements 2 can be mounted at the carrier arrangement 1 detachably and without the use of tools in order to make possible, for example, a use in a high-shelf storage area or in automated conveyor systems.

For assembling a skid arrangement 2, the respective partial block 11 of the carrier arrangement 1 and the cylinder body 47 of the partial block 45 of the respective skid arrangement 2 are arranged above one another. The alignment flanks 52 lead to an alignment between the cylinder body 47 of the respective skid arrangement 2 and the associated hollow cylinder body 12 of the carrier arrangement 1. The central axes 14, 40 are then flush with one another.

The retaining projections 48 and the retaining webs 13 are in this case aligned with one another about the respective central axis 14 or 40 for the assembly of the skid arrangement 2 by means of a relative pivoting movement between the carrier arrangement 1 and the corresponding skid arrangement 2 such that the retaining projections 48 are located in front of or adjacent to gaps between the adjacent retaining webs 13.

The retaining projections 48 then subsequently pass through the gaps. A movement along the respective central axis 14 or 40 takes place between the carrier arrangement 1 and the respective skid arrangement 2. This insertion operation is completed when the base surface 6 of the then upper partial block 11 is arranged adjacent to the head surface 46 of the then lower partial block 45 or lies on top of same. The retaining projections 48 then have a distance to the carrier plate 4, which is shorter than the distance of the retaining webs 13 to the carrier plate 4.

The respective skid arrangement is subsequently manually pivoted about its central axis 40, which is oriented vertically.

On the one hand, this pivoting movement leads to a relative pivoting movement between the retaining webs 13 and the retaining projections 48. The retaining projections 48 move over the retaining webs 13 and extend behind same. They are then located directly above the retaining webs 13, so that the retaining surfaces 49 face towards the adjacent retaining webs 13. The retaining webs 13 are located between the head surface 46 and the retaining projections 48, which brings about a local fixing of the respective skid arrangement 2 at the carrier arrangement 1 in the direction of the central axis 14 or 40.

On the other hand, the pins 32, 33 of the respective skid arrangement 2 are inserted into the respective dovetail groove 18 or 19 via their openings 22 or 23 during this pivoting movement. In this case, the pins 32, 33 of a partial block 31 of the respective skid arrangement 2 enter, for example, from laterally outside into the associated partial block 10 of the carrier arrangement 1, while the pins 32, 33 of the other partial block 31 of the respective skid arrangement 2 enter from laterally inside into the associated partial block 10 of the carrier arrangement 1. The pins 32, 33 of the two partial blocks 31 enter into the corresponding partial blocks 10 of the carrier arrangement 1 from opposing sides.

When the respective skid arrangement 2 is located in its use position, it extends parallel to the longitudinal edges 7. The pins 32, 33 mesh (engage) with the respective dovetail groove 18 and 19. The side flanks 36 and 38 are arranged adjacent to the flanks 21 and 24 of the dovetail grooves 18 and 19 or they are in contact with them.

The locking bodies 41 have entered into the associated locking recess 26 via the respective inlet opening 27. The locking surfaces 42 of the respective locking bodies 41 are arranged adjacent to the side walls 28 or they are in contact with same, which prevents an unintentional pivoting between the carrier arrangement 1 and the respective skid arrangement 2 about the central axis 14 or 40.

The partial blocks 10, 31 form total blocks, while the partial blocks 11, 45 form additional total blocks. The pallet can thus be set down via the base surface 30 of the respective skid arrangement 2 and thus has naturally a greater height than without the skid arrangements 2. A lifting device can be driven between the skid arrangements 2 under the carrier plate 4.

The assembly is carried out in an identical manner in all skid arrangements 2.

In particular, the carrier arrangement 1 is placed onto the corresponding skid arrangement 2 during an assembly of a skid arrangement 2. First a relative insertion movement between the carrier arrangement 1 and the respective skid arrangement 2 and subsequently a pivoting movement are essential.

A disassembly takes place in an essentially analogous manner. For this, first the locking bodies 41 are unmeshed (disengaged) with the locking recesses 26, which is possible by applying pressure from above on the actuating surfaces 43.

The pallet according to FIG. 1 through 3 is elongated; it is thus longer than it is wide. As an alternative, the pallet is square or essentially square.

While specific embodiments of the invention have been shown and described in detail to illustrate the application of the principles of the invention, it will be understood that the invention may be embodied otherwise without departing from such principles.

The invention claimed is:

1. A pallet comprising:

a carrier arrangement for carrying at least one item;

at least two skid arrangements; and at least one reinforcing element for reinforcing the carrier arrangement and/or the respective skid arrangement, wherein the at least one reinforcing element consists of steel sheet and is perforated, the at least one reinforcing element being extrusion-coated in at least some areas by material of the carrier arrangement or of the respective skid arrangement.

2. A pallet in accordance with claim 1, wherein the at least one reinforcing element is arranged at the top and/or at the bottom at a carrier plate of the carrier arrangement.

3. A pallet in accordance with claim 1, wherein the at least one reinforcing element is arranged at the top and/or at the bottom, on the outside, at a bottom element of at least one skid arrangement.

4. A pallet in accordance with claim 1, wherein the at least one reinforcing element is strip-shaped or profiled.

5. A pallet in accordance with claim 1, wherein the at least one reinforcing element is formed of a different material than the carrier arrangement and/or the skid arrangement.

6. A pallet in accordance with claim 1, wherein the at least one reinforcing element consists of high-strength steel.

7. A pallet in accordance with claim 1, wherein the steel sheet is galvanized in at least some areas.

8. A pallet in accordance with claim 1, wherein the steel sheet is trapezoidal or essentially trapezoidal.

9. A pallet in accordance with claim 1, wherein the at least one reinforcing element is extrusion-coated by material of the carrier arrangement or the respective skid arrangement entirely.

10. A pallet in accordance with claim 1, wherein the carrier arrangement is manufactured by injection molding, the carrier arrangement having at least one base surface.

11. A pallet in accordance with claim 1, further comprising at least one receiving space for receiving at least one sensor.

12. A pallet in accordance with claim 11, wherein the at least one receiving space is formed by a hollow chamber of the carrier arrangement or skid arrangement.

13. A pallet in accordance with claim 12, further comprising at least one sensor, wherein the at least one sensor is mounted in the at least one receiving space.

14. A pallet in accordance with claim 1, wherein the carrier arrangement comprises a carrier arrangement partial block extending in a direction of one of the skid arrangements, the carrier arrangement comprising a longitudinal direction, the carrier arrangement partial block comprising a carrier arrangement partial block dovetail groove facing in a direction transverse to the longitudinal direction of the carrier arrangement, the one of the skid arrangements comprising a skid arrangement partial block, the skid arrangement partial block comprising a skid arrangement partial block pin extending upward from a surface of the skid arrangement partial block, the skid arrangement partial block pin being inserted in the carrier arrangement partial block dovetail groove in the direction transverse to the longitudinal direction of the carrier arrangement.

15. A pallet in accordance with claim 14, wherein the carrier arrangement partial block comprises another carrier arrangement partial block dovetail groove facing in the direction transverse to the longitudinal direction of the carrier arrangement, the one of the skid arrangements comprising another skid arrangement partial block pin extending upward from the surface of the skid arrangement partial block, the another skid arrangement partial block pin being inserted in the another carrier arrangement partial block dovetail groove in the direction transverse to the longitudinal direction of the carrier arrangement.

16. A pallet in accordance with claim 14, wherein the carrier arrangement comprises another carrier arrangement partial block extending in the direction of the one of the skid arrangements, the another carrier arrangement partial block being located opposite the carrier arrangement partial block in the longitudinal direction of the carrier arrangement, the one of the skid arrangements comprising another skid arrangement partial block, the another skid arrangement partial block being located opposite the skid arrangement partial block in the longitudinal direction of the carrier arrangement, the another skid arrangement partial body comprising a cylindrical body, the cylindrical body being inserted in an interior of the another carrier arrangement partial block.

17. A pallet in accordance with claim 16, wherein the cylindrical body comprises a plurality of retaining projections.

18. A pallet in accordance with claim 14, wherein the carrier arrangement comprises yet another carrier arrangement partial block extending in a direction of the one of the skid arrangements, the yet another carrier arrangement partial block comprising a yet another carrier arrangement partial block dovetail groove facing in a direction transverse to the longitudinal direction of the carrier arrangement, the one of the skid arrangements comprising yet another skid arrangement partial block, the yet another skid arrangement partial block comprising yet another skid arrangement partial block pin extending upward from a surface of the yet another skid arrangement partial block, the yet another skid arrangement partial block pin being inserted in the yet another carrier arrangement partial block dovetail groove in the direction transverse to the longitudinal direction of the carrier arrangement.

19. A pallet in accordance with claim 18, wherein the another skid arrangement partial block is arranged between the skid arrangement partial block and the yet another skid arrangement partial block in the longitudinal direction of the carrier arrangement, the another carrier arrangement partial block being arranged between the carrier arrangement partial block and the yet another carrier arrangement partial block in the longitudinal direction of the carrier arrangement.

20. A pallet in accordance with claim 18, wherein the yet another carrier arrangement partial block comprises yet another carrier arrangement partial block second dovetail groove facing in the direction transverse to the longitudinal direction of the carrier arrangement, the yet another skid arrangement partial block comprising yet another skid arrangement partial block second pin extending upward from the surface of the yet another skid arrangement partial block, the yet another skid arrangement partial block second pin being inserted in the yet another carrier arrangement partial block second dovetail groove in the direction transverse to the longitudinal direction of the carrier arrangement.

21. A pallet in accordance with claim 18, wherein the carrier arrangement partial block comprises a locking recess, the skid arrangement partial block comprising a locking body, the locking recess receiving at least a portion of the locking body, wherein the locking body is configured to be actuated to disengage the locking body from the locking recess.

22. A pallet in accordance with claim 21, wherein the locking recess faces in the longitudinal direction of the carrier arrangement, the locking body extending in the longitudinal direction of the carrier arrangement.

23. A pallet in accordance with claim 21, wherein the yet another carrier arrangement partial block comprises another locking recess, the yet another skid arrangement partial block comprising another locking body, the another locking recess receiving at least a portion of the another locking body, wherein the another locking body is configured to be actuated to disengage the another locking body from the another locking recess.

* * * * *